US011236634B2

(12) United States Patent
Vyvey

(10) Patent No.: US 11,236,634 B2
(45) Date of Patent: Feb. 1, 2022

(54) TURBINE ENGINE OUTER SHROUD

(71) Applicant: SAFRAN AERO BOOSTERS SA, Herstal (BE)

(72) Inventor: Morgan Vyvey, Flemalle (BE)

(73) Assignee: SAFRAN AERO BOOSTERS SA, Herstal (BE)

( * ) Notice: Subject to any disclaimer, the term of this patent is extended or adjusted under 35 U.S.C. 154(b) by 0 days.

(21) Appl. No.: 16/650,622

(22) PCT Filed: Jun. 20, 2019

(86) PCT No.: PCT/EP2019/066318
§ 371 (c)(1),
(2) Date: Aug. 21, 2020

(87) PCT Pub. No.: WO2019/243484
PCT Pub. Date: Dec. 26, 2019

(65) Prior Publication Data

US 2020/0392862 A1 Dec. 17, 2020

(30) Foreign Application Priority Data

Jun. 21, 2018 (BE) ..... 2018/5429

(51) Int. Cl.
*F01D 17/16* (2006.01)
*F04D 29/56* (2006.01)
*F04D 29/64* (2006.01)

(52) U.S. Cl.
CPC ..... *F01D 17/162* (2013.01); *F04D 29/563* (2013.01); *F04D 29/644* (2013.01); *F05D 2220/32* (2013.01); *F05D 2240/128* (2013.01)

(58) Field of Classification Search
CPC ..... F01D 11/08; F01D 9/04; F01D 11/005; F01D 11/12; F01D 11/001; F05D 2240/11; F05D 2240/55
See application file for complete search history.

(56) References Cited

U.S. PATENT DOCUMENTS 3,314,654 A * 4/1967 Thenault ..... F01D 17/162 415/160
4,130,375 A * 12/1978 Korta ..... F01D 5/081 415/161

(Continued)

FOREIGN PATENT DOCUMENTS

EP 0636766 A1 2/1995
EP 1760272 A2 * 3/2007 ..... F04D 29/563

(Continued)

OTHER PUBLICATIONS

International Search Report dated Sep. 6, 2019 for Parent PCT Appl. No. PCT/EP2019/066318.

*Primary Examiner* — Woody A Lee, Jr.
*Assistant Examiner* — Brian Christopher Delrue
(74) *Attorney, Agent, or Firm* — James E. Walton

(57) ABSTRACT

The invention relates to a turbine engine (2) compressor shroud, comprising: first and second sections (130, 230) and respective flanges (131, 231), the flanges (131, 231) making it possible to hold the two sections (130, 230) together, the first section (130) comprising a cylindrical surface (137) forming a seat for an actuating device (136, 140, 166, 168, 170) for orienting stator blades (126), characterised in that the first shroud (130) comprises a tubular wall (132) axially overlapping both flanges (131, 231) and said cylindrical surface (137) is an outer surface of the tubular wall (132). The invention also relates to an assembly with the shroud (130, 230), the blade (126) and means (140) for actuating the orientation of the blade (126), the shroud being produced using the kit described above. The invention finally relates to a method for assembling a compressor with such an assembly.

8 Claims, 4 Drawing Sheets

(56) References Cited

U.S. PATENT DOCUMENTS

| | | | | | |
|---|---|---|---|---|---|
| 4,363,600 | A * | 12/1982 | Thebert | F01D 17/162 | 415/140 |
| 4,834,613 | A * | 5/1989 | Hansen | F01D 17/162 | 415/160 |
| 4,861,228 | A * | 8/1989 | Todman | F01D 17/162 | 415/115 |
| 6,790,000 | B2 * | 9/2004 | Wolf | F01D 17/162 | 415/165 |
| 7,510,369 | B2 * | 3/2009 | Lytle | F04D 29/563 | 415/160 |
| 9,932,988 | B2 * | 4/2018 | Maliniak | F01D 17/162 | |
| 10,125,789 | B2 * | 11/2018 | Maliniak | F04D 29/563 | |
| 10,280,941 | B2 * | 5/2019 | Mouton | F04D 29/644 | |
| 10,526,911 | B2 * | 1/2020 | Pratt | F01D 25/246 | |
| 2003/0113204 | A1 * | 6/2003 | Wolf | F01D 25/16 | 415/165 |
| 2016/0160675 | A1 | 6/2016 | Williamson et al. | | |
| 2016/0290360 | A1 * | 10/2016 | Tanaka | F04D 29/526 | |
| 2018/0045218 | A1 * | 2/2018 | Mouza | F01D 25/243 | |

FOREIGN PATENT DOCUMENTS

| | | | | |
|---|---|---|---|---|
| GB | 705150 | A * | 3/1954 | F01D 25/12 |
| GB | 805015 | A | 11/1958 | |
| WO | 2014143445 | A2 | 9/2014 | |

* cited by examiner

TURBINE ENGINE OUTER SHROUD

TECHNICAL FIELD

The invention relates to the field of axial turbomachinery and more particularly aircraft turbojets. More specifically, the invention relates to the design of an outer shroud of a compressor provided with stator vanes with variable orientation. The invention also relates to an assembly kit and a turbomachine provided with such a shroud, as well as an assembly method.

BACKGROUND ART

The document US 2016/0160675 describes an axial turbomachine with a particular arrangement of the trunnions of stator vanes with variable orientation in an external compressor shroud. The vane orientation actuation system is positioned downstream of each vane. A connecting rod, denoted 80, makes it possible to adjust the pivoting of the vanes. This connecting rod can be manipulated by a synchronization ring, so that all the vanes of a given stage are oriented synchronously. The synchronization ring is also called a handling ring, an actuation ring or a control ring.

Such a ring can sometimes rest directly on the outer shroud.

Such a design is possible in the system of the document cited above, which comprises several stages of compression with variable vanes with an external shroud extending over several of these stages. Such a shroud is cumbersome.

In a compressor with a shorter shroud or fewer compression stages, such a mechanism is unnecessarily cumbersome.

SUMMARY OF THE INVENTION

Technical Problem

The object of the invention is to solve at least one of the problems posed by the prior art. The invention also aims to provide a simpler and more compact design, allowing easier mounting of the vanes with variable orientation and of the mechanism for actuating the orientation of the vanes. The invention also aims to provide a light solution.

Technical Solution

The subject of the invention is a kit for assembling an external turbomachine shroud, in particular for a turbomachine compressor, the kit comprising a first axial section of external shroud and a second axial section of external shroud, each of the sections comprising a respective flange, the flanges being intended for assembling the sections together, the first section comprising a cylindrical surface coaxial with the sections and forming a seat for a device for actuating the orientation of stator vanes, remarkable in that the first section comprises a tubular wall axially overlapping the two flanges and said cylindrical surface is an external surface of the tubular wall.

By "shroud" is meant a part that is substantially of symmetrical around an axis. The axial sections of the shroud are portions of a shroud.

Thus, the cylindrical surface surrounds the flanges and makes the whole assembly more compact.

According to preferred embodiments of the invention, the kit can include one or more of the following characteristics, taken in isolation or according to all possible technical combinations:

- The tubular wall and the flange of the first section form a "T"-shaped outline.
- The tubular wall and the flange of the first section are integrally made.
- The kit includes a ring, a plurality of stator vanes and as many operating rods capable of connecting the vanes to the ring. The ring can be in direct or indirect contact with the cylindrical surface.
- The kit includes pads able to be fixed to the ring and able to come into contact with the cylindrical surface.
- The kit includes sleeves each comprising a tubular portion to cooperate with a rod or with the ring, and a cylindrical or rectangular portion to cooperate with a pad.
- The kit includes a plurality of screw-nut pairs, the flanges comprising orifices which can be traversed by the screws to hold the sections together by screwed assembly.
- The holes are axial and such that, once the kit is assembled, the nuts are parallel to the cylindrical surface.
- At least one of flanges and/or the tubular wall and/or the sections is/are composed of an alloy of titanium, aluminum or magnesium and/or of composite material.
- The first section includes an annular row of radial orifices capable of receiving stator vane heads.
- The first section is made by assembling two half-sections, each of the half-sections comprising an annular row of semi-cylindrical radial half-orifices, the half-orifices being arranged to allow each of the half-orifices of a half-section to be brought into axial and circumferential correspondence with a half-orifice of the other half-section to form the annular row of radial orifices.
- The half sections are assembled using respective flanges positioned circumferentially between two adjacent half-holes, each circumferential spacing between two adjacent half-holes containing one of the flanges.
- The flanges are flanks extending perpendicular to the axis of symmetry of the shroud and having an axial thickness, the cylindrical surface extending axially over a length of more than three times the sum of the axial thicknesses of the two flanges.

The invention also relates to an assembly for an axial turbomachine, in particular for an aircraft turbojet, and preferably assembled using a kit as described above, the assembly comprising: an annular row of stator vanes each with an airfoil and a radial head containing a cylindrical trunnion, the vanes being orientable by pivoting about the axis of the trunnion; a device for actuating the pivoting of the vanes comprising a synchronization ring and operating rods connecting the synchronization ring to each of the vanes; an outer shroud comprising a tubular wall and having an annular row of radial orifices for receiving the heads of the vanes; the shroud comprising two axially adjacent tubular sections, the sections being assembled by means of respective flanges, the first section comprising a cylindrical surface forming a seat for the actuating device, remarkable in that the cylindrical surface is an external surface of a tubular wall axially overlapping the two flanges.

According to a preferred embodiment of the invention, the ring carries pads in radial contact with the cylindrical surface. The pads are arranged in an annular row.

The invention also relates to an axial turbomachine, in particular an aircraft turbojet, with a low-pressure compressor, a high-pressure compressor and an intermediate passage between the low-pressure compressor and the high-pressure compressor, remarkable in that the low-pressure compressor, the intermediate passage and/or the high-pressure compressor comprise(s) an assembly as described above.

In an unclaimed embodiment, a method of assembling such an assembly is defined using such a kit, the method comprising the following steps: the introduction of the vane heads into the radial orifices of the first section; assembling the pads, rods and connecting rods to the ring; assembling a connecting rod at the head of each vane; fixing, preferably by screwing, the flanges of the two sections together.

According to a preferred embodiment, the method comprises a step of assembling the half-sections carried out after the step of assembling the connecting rods to the vanes.

According to other aspects of the invention, the kit can include one or more of the following features, taken in isolation or according to all possible technical combinations:

- An annular row of radial bosses receives the half-orifices.
- The bosses have a semi-conical outer surface and a semi-cylindrical inner surface forming the half-orifice. The bosses can alternatively be semi-cylindrical.
- The bosses are connected to one another circumferentially by the assembly flanges of the half-sections.
- The flanges between the half-sections radially overlap the synchronization ring and are axially spaced from it.

The invention is not limited to the assembly for a turbomachine or to the assembled shroud, but also relates to a kit of parts allowing the assembly of an assembly, a shroud, a compressor or a turbomachine as described below. The technical characteristics detailed in relation to the kit are also in particular technical characteristics of the shroud or of the assembly for a turbomachine and vice versa.

In general, the embodiments of each object of the invention are also applicable to the other objects of the invention. Each object of the invention can be combined with the other objects, and the objects of the invention can also be combined with the embodiments of the description, which in addition can be combined with one another, according to all possible technical combinations, unless the opposite is explicitly mentioned.

Benefits

The invention proposes a specific geometry which is particularly compact. In addition, the positioning of the cylindrical surface above the flanges allows good rigidity of the seat of the actuating device.

DETAILED DESCRIPTION OF PREFERRED EMBODIMENTS

In the following description, the terms "internal" and "external" refer to a positioning relative to the axis of rotation of an axial turbomachine. The axial direction corresponds to the direction along the axis of rotation of the turbomachine. The radial direction is perpendicular to the axis of rotation. Upstream and downstream are in reference to the main flow direction of the flow in the turbomachine.

Figure 1A:
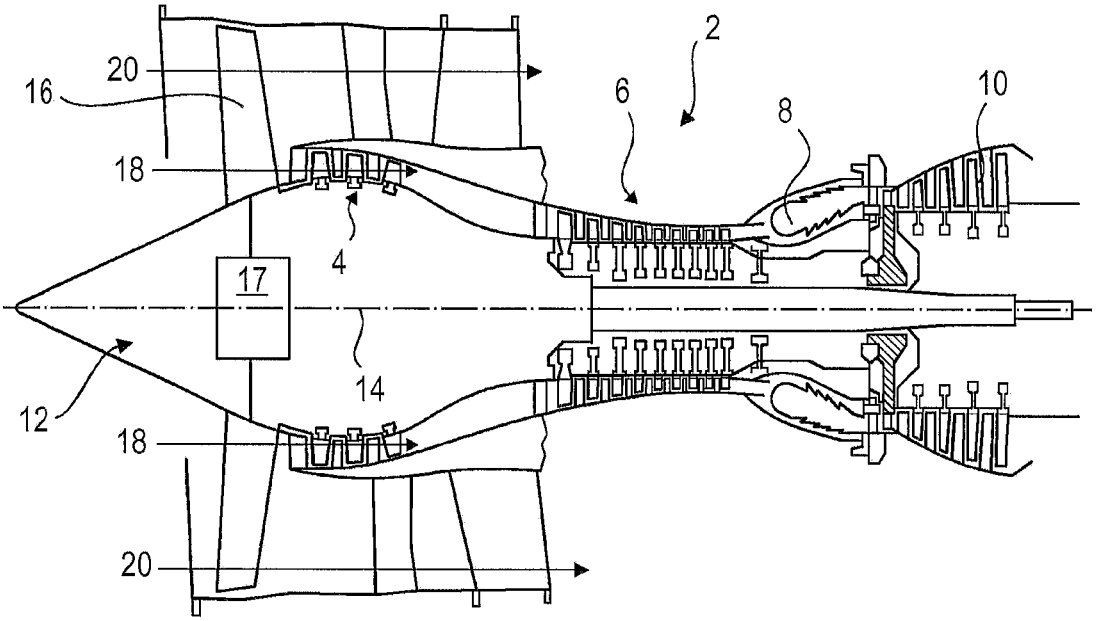
FIGS. 1A and 1B represent an axial turbomachine.

FIG. 1A shows a simplified axial turbomachine. This is here a two-stream turbojet engine. The turbojet engine 2 comprises a first stage of compression, called a low-pressure compressor 4, a second stage of compression, called a high-pressure compressor 6, a combustion chamber 8 and one or more stages of turbines 10. In operation, the mechanical power from the turbine 10 transmitted via the central shaft to the rotor 12 sets in motion the two compressors 4 and 6. The latter comprise several rows of rotor vanes associated with rows of stator vanes. The rotation of the rotor around its axis of rotation 14 thus makes it possible to generate an air flow and to gradually compress the latter until the inlet of the combustion chamber 8.

An inlet fan 16 is coupled to the rotor 12 via a gear 17, and generates an air flow which is divided into a primary flow 18 passing through the various aforementioned different stages of the turbomachine, and by a secondary flow 20 passing through an annular duct (partially shown) along the machine to then join the primary flow at the outlet of the turbine.

The secondary flow can be accelerated so as to generate a thrust necessary for the flight of an aircraft. The primary flow 18 and secondary flow 20 are annular coaxial flows fitted into one another.

Figure 1B:
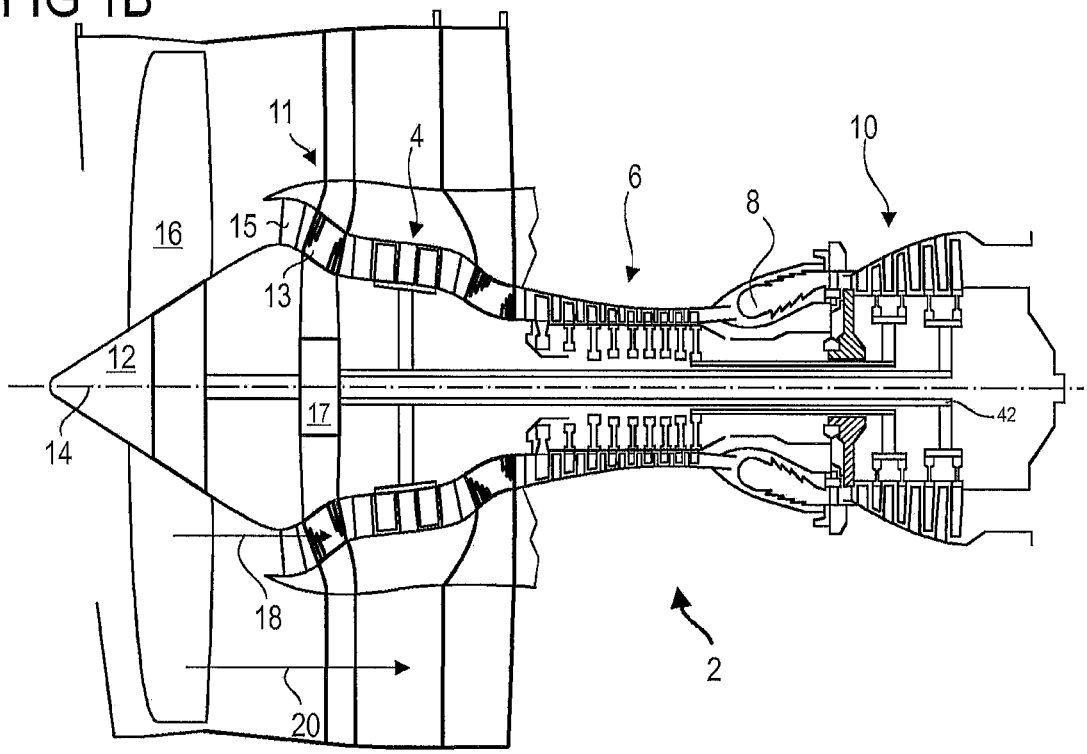

FIG. 1B represents an axial turbomachine 2 with an alternative architecture to that of FIG. 1A. The same reference numbers represent the same elements. The difference between the two architectures is the presence in this embodiment of a casing 11 carrying the gear 17, in particular via radial arms (so-called "struts") 13. The radial arms 13 can be directly downstream of a row of stator vanes 15.

In the following, the illustrated embodiment relates to the architecture of FIG. 1A but all the technical features of the invention can also be provided on a turbomachine with an architecture according to FIG. 1B.

Figure 2:
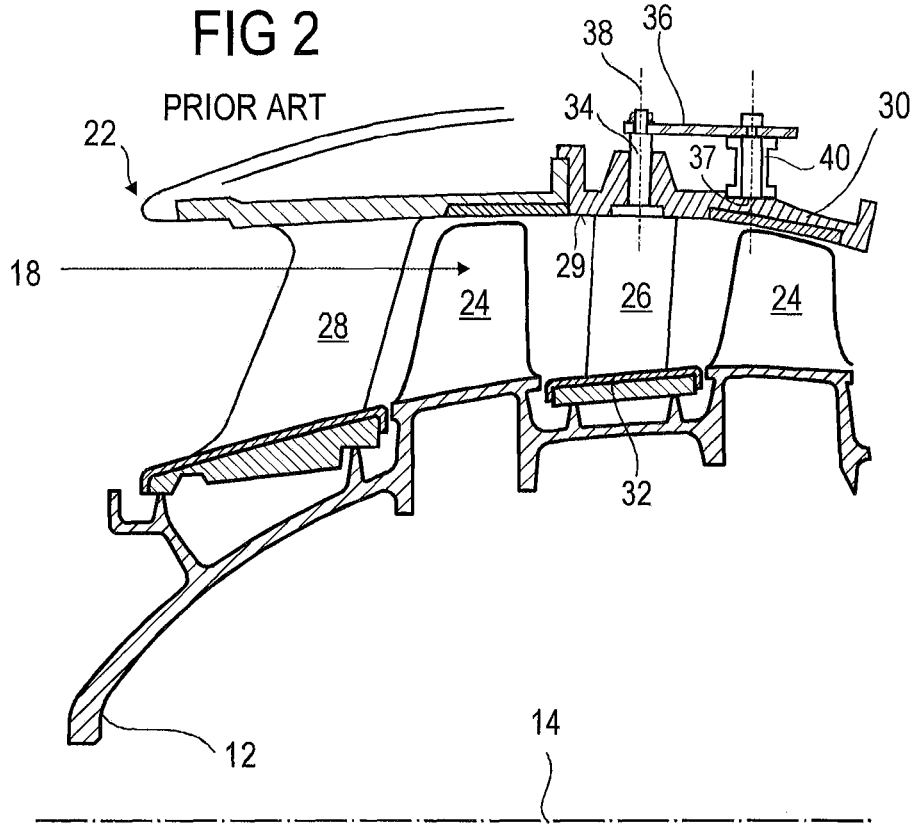
FIG 2 PRIOR ART
FIG. 2 is a diagram of a turbomachine compressor according to the background art.

FIG. 2 is a sectional view of a compressor of an axial turbomachine such as that of FIG. 1, with an outer shroud according to the prior art. The compressor can be a low-pressure compressor 4. The rotor 12 comprises several rows of rotor vanes 24. It can consist of a monobloc bladed drum or of monobloc bladed discs. Alternatively, it may include vanes fixed with dovetail couplings.

The low-pressure compressor 4 comprises several rectifiers (flow straighteners), for example four, which each contain a row of stator vanes 26. Some stator vanes can have an adjustable orientation, also called variable stator vanes. The rectifiers are associated respectively with a row of rotor vanes to straighten the air flow, so as to convert the speed of the flow into pressure, in particular into static pressure.

A nose 22 which can have defrosting functions can be mounted on a casing which supports a row of stator inlet vanes 28.

The stator vanes 26 extend essentially radially from an external shroud 30 towards internal rings 32. The vanes 26 can be fixed to the external shroud 30 using pins or trunnions 34. The shroud 30 defines an internal surface 29 which guides the gas flow. The compressor may comprise several adjacent axial sections to form the shroud 30.

In this example, the pin 34 is pivotally driven by a connecting rod 36 around the axis 38 of the pin 34. The rod 36 is connected with the pin 34, fixed for example by a nut.

The connecting rods of the annular row of vanes 26 are all connected to a synchronization ring 40 by means of rods 42.

The ring 40 rests on a cylindrical or conical surface 37.

Figure 3:
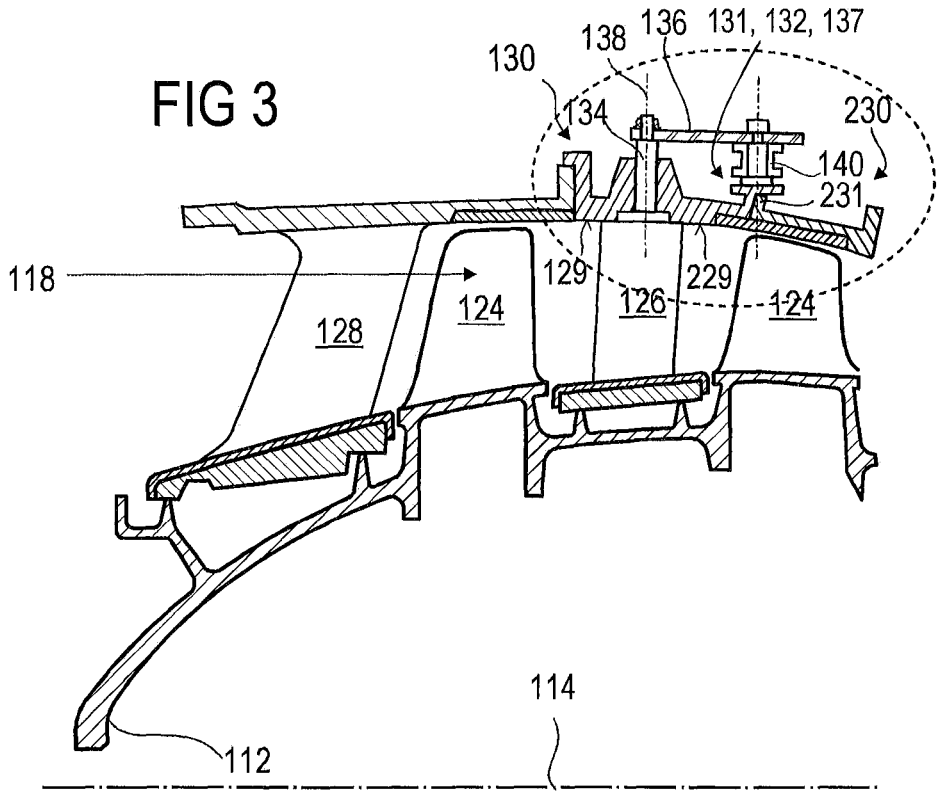
FIGS. 3 and 4 respectively show a compressor according to the invention with a shroud and an enlarged part of the shroud.

FIG. 3 partially shows the compressor assembled from the kit according to the invention. The numbers are incremented by 100 to designate technical characteristics corresponding to those in FIG. 2.

In comparison with FIG. 2, the shroud of the invention comprises a first section 130 and a second section 230. The sections describe an internal surface for guiding the gas flow 129, 229. The sections comprise respective flanges 131, 231 facing each other to assemble the compressor.

The first section 130 has a tubular wall 132 defining a cylindrical external surface 137.

Figure 4:
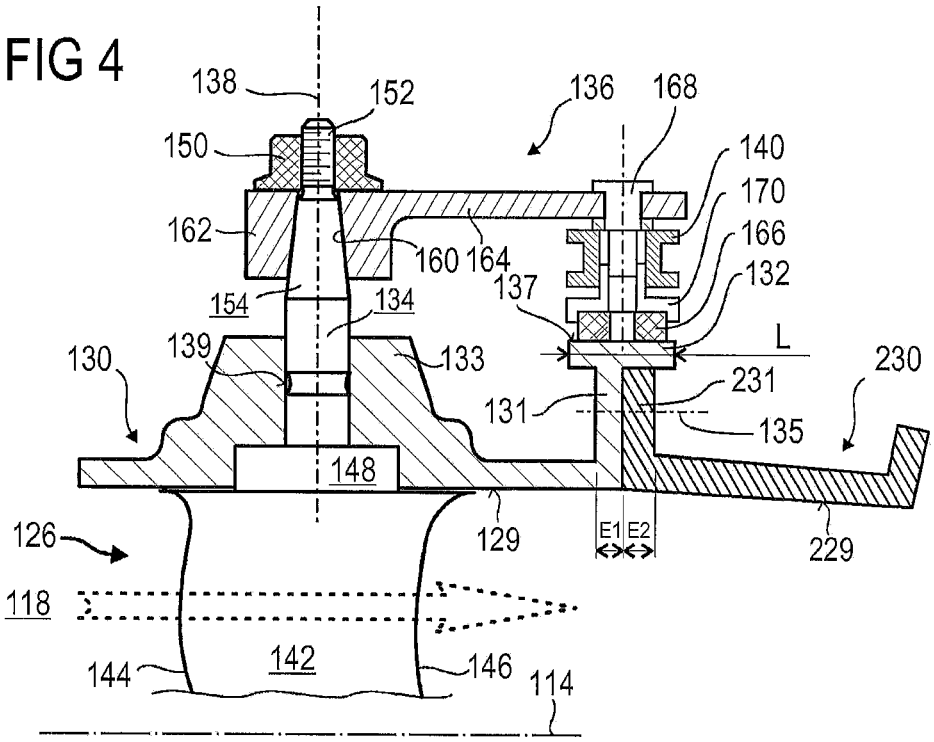

More details on this subject are given in FIG. 4 which is an enlargement of the zone indicated with a dotted line on FIG. 3.

The vane 126 comprises an airfoil 142 having a leading edge 144 and a trailing edge 146. The head of the vane 126 may include a shoulder 148 for centering and positioning the vane 126 in the shroud 130 and a groove for receiving a seal.

The connecting rod 136 for pivoting the vane is fixed by a nut 150 to a threaded portion 152 of the vane head. A centering chamfer 154 may be provided at the end of the trunnion 134.

The head of the vane is received within an over thickness of the shroud 130, which may be in the form of a boss 133.

The connecting rod 136 may include a conical orifice 160 corresponding to the chamfer 154, a body 162 and a tab 164. The orifice 160 may include a groove for receiving a key and thus make the vane 126 and the connecting rod 136 unified in rotation.

In this example, the tubular wall 132 is integrally formed with the flange 131. These together form a "T"-shaped outline. Alternatively, the tubular wall may be radially distant from the flange.

An axis 135 shows diagrammatically the junction between the flanges 131, 231 which can be made by screwed elements.

The cylindrical surface 137 acts as a support for pads 166 carried by the ring 140.

A rod 168 provides the connection between the connecting rod 136 and the ring 140. A sleeve 170 ensures the connection of the pads 166 to the rod 168 and/or to the ring 140.

The ring 140 is in the form of a solid ring or two half-rings, with a plurality of radial holes penetrated by the rods 168. These holes can be threaded.

The ring 140 may have annular grooves on its upstream and downstream face in order to optimize its weight without compromising its rigidity.

The synchronization ring 140 cooperates with as many rods 168 as the number of connecting rods 136 distributed annularly. The ring 140 can be pivotally actuated around the axis 114 by suitable means such as for example a toothed wheel cooperating with a rack provided on the ring 140. The rack can be housed in one of the grooves of the ring 140. The pivoting of the ring 140 causes a corresponding displacement of the rods 168 along the surface 137 and the latter thus pivot the connecting rods 136 and the vanes 126 around their axes 138.

The pads 166 can be directly connected to the ring 140 or to the rod 168.

Alternatively, an intermediate sleeve 170 can be provided for each rod 168 and each pad 166.

Figure 5:
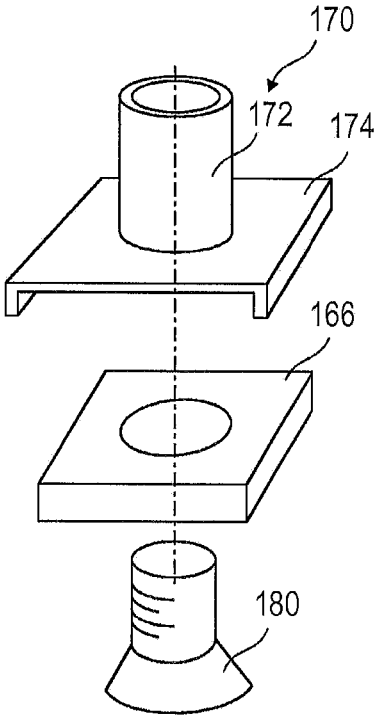
FIG. 5 illustrates a sleeve which can be used in an assembly according to the invention.

The sleeve 170 is described in FIG. 5. This comprises a tubular portion 172 which can be threaded on the outside to be inserted in the ring 140 and/or on the inside to receive the rod 168. The sleeve also includes a rectangular portion 174 which makes it possible to hold the pad 166 by gluing, shrinking or screwing—for example using a countersunk screw 180 inserted from below and the head of which will be embedded in the pad 166. The portion 174 can alternatively be cylindrical to accommodate a cylindrical pad.

In the example of FIGS. 4 and 5, the external shroud 130 has an opening 139 receiving the pin 134. The pin 134 is inserted into the hole 139 from the bottom (in the direction of FIG. 4), then the connecting rod 136 is screwed in using thread 52.

Figure 6:
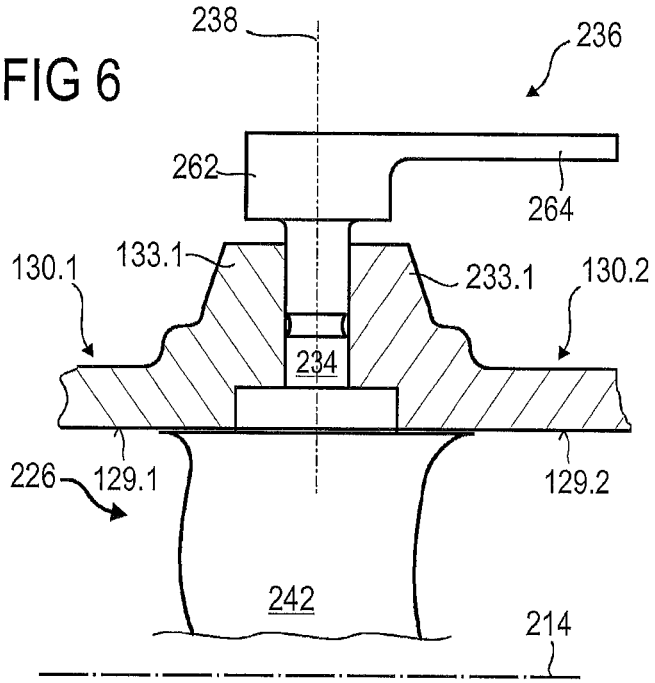
FIG. 6 is a section of a vane with a one-piece connecting rod used in a second embodiment of the invention.
Figure 7:
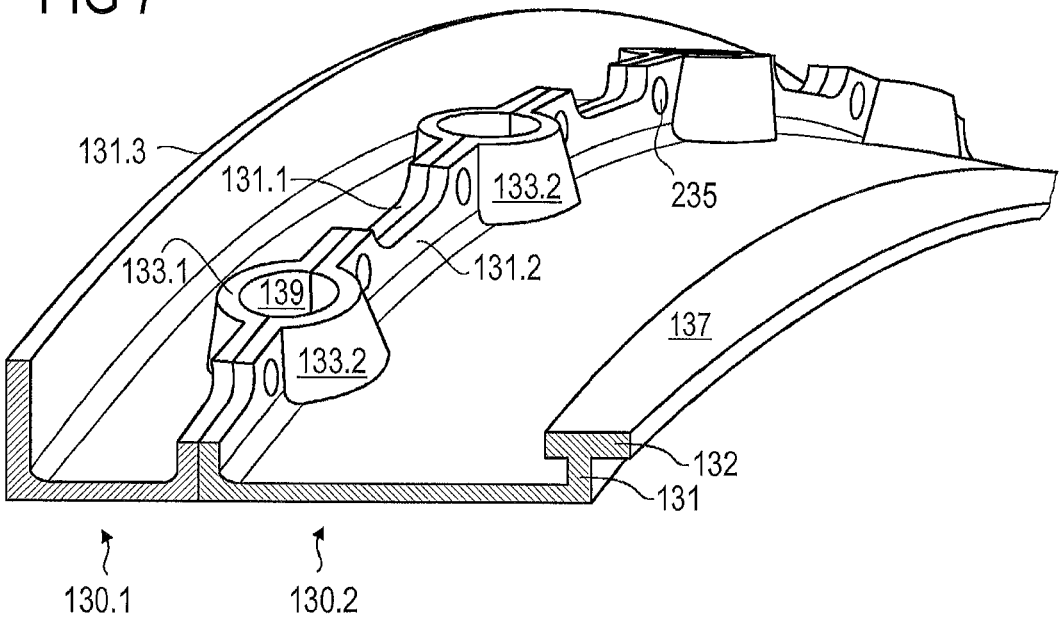
FIG. 7 is a partial isometric view of the first section in this second embodiment.

FIGS. 6 and 7 show a different arrangement. These are described together in the following paragraphs. The reference numbers of the vane and of the connecting rod are incremented by 100 with respect to the embodiment of FIGS. 3 to 5.

The vane 226 is in one piece with the connecting rod 236 and the orifice of the shroud 130 receiving the pin 234 is made of two half-orifices (139.1, 139.2 in FIG. 7).

Two half-sections 130.1 and 130.2 form the shroud 130. Each of the half-sections 130.1, 130.2 comprises a tubular wall defining an internal guide surface 129.1, 129.2 and an annular series of half-orifices 139.1, 139.2, formed in half bosses 133.1, 133.2. The two half-orifices 139.1, 139.2 form the orifice 139 which receives the pin 234 of the vane 226. The two half-sections 130.1, 130.2 are assembled via screwed elements which hold two adjacent flanges 131.1, 131.2 together. The flanges 131.1, 131.2 may extend from a boss to the adjacent circumference.

The rod 236 is integrally made with the head of the vane. For example, the connecting rod can be forged or molded with the rest of the vane. The functional surfaces (pin, upper surface/lower surface) are then machined. Alternatively, a welded connection can be made. This is done before mounting the vane in the shroud. As the opening 139 results from the combination of the two half-sections 130.1, 130.2, the pin 234 can be positioned in a half-opening 139.1, 139.2 of the half-section 130.1 despite the dimension of the connecting rod being greater than the diameter of orifice 139, then the other half-section 130.2 is fixed to enclose the pin 234 in the orifice 139. The synchronization ring provided with its pads can be mounted on the second section of shroud before the vanes are mounted in the half-holes 139.1, 139.2.

FIG. 7 represents an isometric partial view of the shroud 130 of this second embodiment. We see in particular some of the bosses 133.1, 133.2 as well as the flanges 131.1, 131.2 and their assembly holes (only the holes 235 of the downstream half-section 130.2 are visible). The flanges can completely connect each of the bosses 133.1, 133.2 to the neighboring boss. The upstream half-section 130.1 comprises a flange 131.3 which makes it possible to connect the shroud to the nose of the compressor. The downstream half-section 130.2 comprises the bearing surface 137 on the tubular wall 132, which forms a "T"-shaped outline with the flange 131.

In the illustrated examples, the surface 137 is presented as cylindrical but in the context of the present invention it is also possible to provide any profile for the surface 137, in particular conical or with a profile complementary to that of the pads, such as in particular an external groove allowing to guide pads fitted with a pin extending radially inward.

The invention claimed is:

1. An assembly for a compressor of a turbomachine, the compressor compressing an air flow, the assembly comprising:

an annular row of stator vanes each with an airfoil and a radial head containing a cylindrical trunnion, the vanes being orientable by pivoting around the axis of the cylindrical trunnion;

an actuating device for pivoting the vanes; and an outer shroud comprising:

a first section and a second section, each comprising a radially internal surface guiding the air flow, one of the first or second section having an annular row of radial orifices for receiving the radial heads of the vanes, the first and second sections being tubular and arranged axially adjacent to one another, the first and second sections being assembled by means of respective flanges, the first section of the two sections comprising:

a cylindrical surface that is coaxial with the first and second sections and that forms a seat for the actuating device;

wherein the cylindrical surface is an external surface of a tubular wall axially overlapping the flanges.

2. The assembly according to claim 1, wherein at least one of the flanges and/or the tubular wall and/or the sections is/are composed of an alloy of titanium, aluminum, or magnesium, and/or composite material.

3. The assembly according to claim 1, wherein the first section is constituted by an assembly of two half-sections, each of the half-sections comprising:

an annular row of semi-cylindrical radial half-orifices, the half-orifices being arranged to allow each of the half-orifices of a half-section to be brought into axial and circumferential correspondence with a half-orifice of the other half-section to form the annular row of radial orifices.

4. The assembly according to claim 3, wherein the half-sections are assembled using respective half-section flanges positioned circumferentially between two adjacent half-orifices, two adjacent half-orifices presenting a spacing therebetween, wherein each circumferential spacing between two adjacent half-orifices contains one of the respective half-section flanges.

5. An assembly for a turbomachine, the assembly comprising:

an annular row of stator vanes each with an airfoil and a radial head containing a cylindrical trunnion, the vanes being orientable by pivoting around the axis of the cylindrical trunnion;

an actuating device for pivoting the stator vanes; and an outer shroud comprising:

a first section and a second section, one of the first or second section having an annular row of radial orifices for receiving the radial heads of the vanes, the first and second sections being tubular and arranged axially adjacent to one another, the first and second sections being assembled by means of two flanges, the first section comprising:

a cylindrical surface that forms a seat for the actuating device, wherein the cylindrical surface is an external surface of a tubular wall axially overlapping the two flanges, the tubular wall and the flange of the first section forming a "T"-shaped cross section, wherein the flanges are flanks extending perpendicular to an axis of symmetry of the outer shroud and having an axial thickness, the cylindrical surface extending axially over a length of more than three times the sum of the axial thicknesses of the two flanges.

6. The assembly according to claim 5, wherein the tubular wall and the flange of the first section are integrally made.

7. An assembly for a turbomachine, the assembly comprising:

an annular row of stator vanes each with an airfoil and a radial head containing a cylindrical trunnion, the vanes being orientable by pivoting around the axis of the trunnion;

an actuating device for pivoting the vanes comprising:

a synchronization ring and operating rods connecting the synchronization ring to each vane;

an outer shroud comprising:

a first section and a second section, one of the first or second section having an annular row of radial orifices for receiving the radial heads of the vanes, the first and second sections being tubular and arranged axially adjacent to one another, the first and second sections being assembled by means of two flanges, the first section comprising:

a cylindrical surface that forms a seat for the actuating device, wherein the assembly further comprises pads fixed to the ring and coming into contact with the cylindrical surface.

8. The assembly according to claim 7, further comprising:

sleeves, each of which comprising:

a tubular portion for cooperating with a rod or with the ring; and a rectangular portion or cylindrical portion to cooperate with a pad.

* * * * *